US005871056A

United States Patent [19]

Renna

[11] Patent Number: 5,871,056

[45] Date of Patent: Feb. 16, 1999

[54] TOTALLY ENCLOSED FUSIBLE DISC HEAT DETECTOR

[76] Inventor: Edward M. Renna, 3231 Drane Field Rd., Lakeland, Fla. 33811-1368

[21] Appl. No.: 796,919

[22] Filed: Feb. 6, 1997

[51] Int. Cl.[6] ..... A62C 37/48

[52] U.S. Cl. ..... 169/43; 169/42; 169/65

[58] Field of Search ..... 169/42, 43, 46, 169/47, 59, 65, DIG. 3

[56] References Cited

U.S. PATENT DOCUMENTS 5,645,128 7/1997 Schwall ..... 169/42

FOREIGN PATENT DOCUMENTS 346740 1/1922 Germany ..... 169/59

*Primary Examiner*—Andrew C. Pike

*Attorney, Agent, or Firm*—George A. Bode; Michael L. Hoelter; Bode & Associates

[57] ABSTRACT

A method and apparatus generates slack in a tensioned cable upon the presence of flame or excessive heat in a predetermined area. The apparatus comprises an enclosure having first, second, and third openings therein with the tensioned cable extending between the first and second openings; a pulley positioned on the cable intermediate the first and second openings the pulley having an eyelet extending therefrom; and a fusible disc secured to the third opening with the fusible disc having a hook extending therefrom and into the enclosure. The hook is attached to the eyelet of the pulley for restraining the pulley, and hence the tensioned cable, in a nonlinear or offset position with respect to the first and second openings. The fusible disc comprises a melting alloy which, upon reaching a known temperature level, undergoes a change in physical properties so as to allow the fusible disc to separate, thereby releasing restraint on the pulley and hence introducing slack into the tensioned cable.

20 Claims, 3 Drawing Sheets

TOTALLY ENCLOSED FUSIBLE DISC HEAT DETECTOR

BACKGROUND OF THE INVENTION

1. Field of the Invention

This invention pertains to automatic stove top fire extinguishing systems in general and, more particularly, to a means of supplying slack to a cable in the event of a fire in order to automatically activate the extinguishing system.

2. General Background

Many devices currently exist that pertain to the automatic extinguishing of stove top fires. Typical examples of such systems are shown in U.S. Pat. No. 5,127,479 issued to Stehling et al., and U.S. Pat. No. 4,773,485 issued to Silverman. In both of these examples, a fire extinguisher is installed in a hood positioned above the stove top. Piping or tubing is secured to the discharge nozzle of these fire extinguishers which lead to release or exit ports located above the most likely place for a fire on the stove top. The control handle of these fire extinguishers are biased in the operable position, but held inoperable by a cable system. The cable system itself contains a series of exposed segmented cables all held together by equally exposed fusible or reusable heat-activated links distributed above the stove top. Thus, upon the occurrence of a fire, these fusible links melt, thereby releasing the cable that holds the control handle of the fire extinguisher in the inoperable position. Upon the release of the cable, the fire extinguisher is allowed to discharge its contents which travel through the piping or tubing and out the exit ports onto the stove top or fire.

An improvement to the system disclosed above is shown in U.S. Pat. No. 5,297,636 issued to North. This system operates in a similar manner but it also includes the feature of automatically closing the valve that supplies gas to the stove burners in the event of a fire.

Alternate versions of extinguishing stove top fires are shown in U.S. Pat. No. 3,584,688 issued to Duncan et al. and U.S. Pat. No. 4,580,638 issued to Jones et al. While these versions also rely upon a series of exposed segmented cables held together by equally exposed fusible links, the fire extinguishing material is contained in a stand-alone structure some distance from the stove.

While all of the above methods would seem to be operable, there is always the possibility that over time their exposed fusible links may carbonize or accumulate a layer of hardened grease which may catastrophically affect their operation in a time of need. Additionally, the exposed segmented cables of such a system may also become encrusted with grease or other matter, thereby affecting their operation, such as by restricting the ability of the cable to freely bend around its pulleys or slide along its guides. Also, since both the fusible links and the cables are exposed, it is also possible that the system will accidently become tripped during routine cleaning.

OBJECTS OF THE INVENTION

For these and other reasons it is an object of this invention to provide a new means of detecting a fire that may occur on a stove top.

Another object of this invention is to provide a fusible link that is totally enclosed such that the problems associated with the accumulation of grease or other matter is no longer relevant.

Still another object of this invention is to provide a fire detection system that does not require the joining of multiple segments of a cable for operation.

Yet another object of this invention is to provide a fire detection system whose fusible link is easily replaced, if needed, without requiring elaborate reconfiguration or re-wiring of the cables or the other hardware already installed.

Still another object of this invention is to provide a system whose cables can also be fully enclosed if desired so as to further insure their proper operation when the time comes.

Yet another object of this invention is the ability to detect heat whether occurring by vapors, smoke, or fire and to respond accordingly once a certain temperature level is reached, regardless of how such heat is conveyed.

Still another object of this invention is to provide a fusible link that is rather inexpensive to replace with this fusible link being the only item requiring such replacement (along with the fire extinguishing material of course) upon the eruption of a stove top fire.

SUMMARY OF THE PRESENT INVENTION

The preferred embodiment of the apparatus of the present invention solves the aforementioned problems in a straightforward and simple manner. What is disclosed is a method and apparatus for generating cable slack in a tensioned cable upon the presence of flame or excessive heat. It consists primarily of an enclosure having first, second, and third sealable openings therein with the tensioned cable extending between or through these first and second openings. A pulley is positioned on the cable intermediate these first and second openings with this pulley having an eyelet extending therefrom. A fusible disc is sealably inserted within the third opening with this fusible disc having a hook extending into the enclosure. This hook is attached to the eyelet of the pulley in order to restrain the pulley, and hence the tensioned cable, in a non-linear or offset position with respect to the first and second openings. The construction of this fusible disc includes a melting alloy which, upon the application of heat, undergoes a change in its physical properties (i.e., a reduction in its tension strength) so as to now permit the tensioned fusible disc to separate. This separation consequently results in the release of restraint on the pulley by the fusible disc, thereby allowing slack to be introduced into the tensioned cable.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
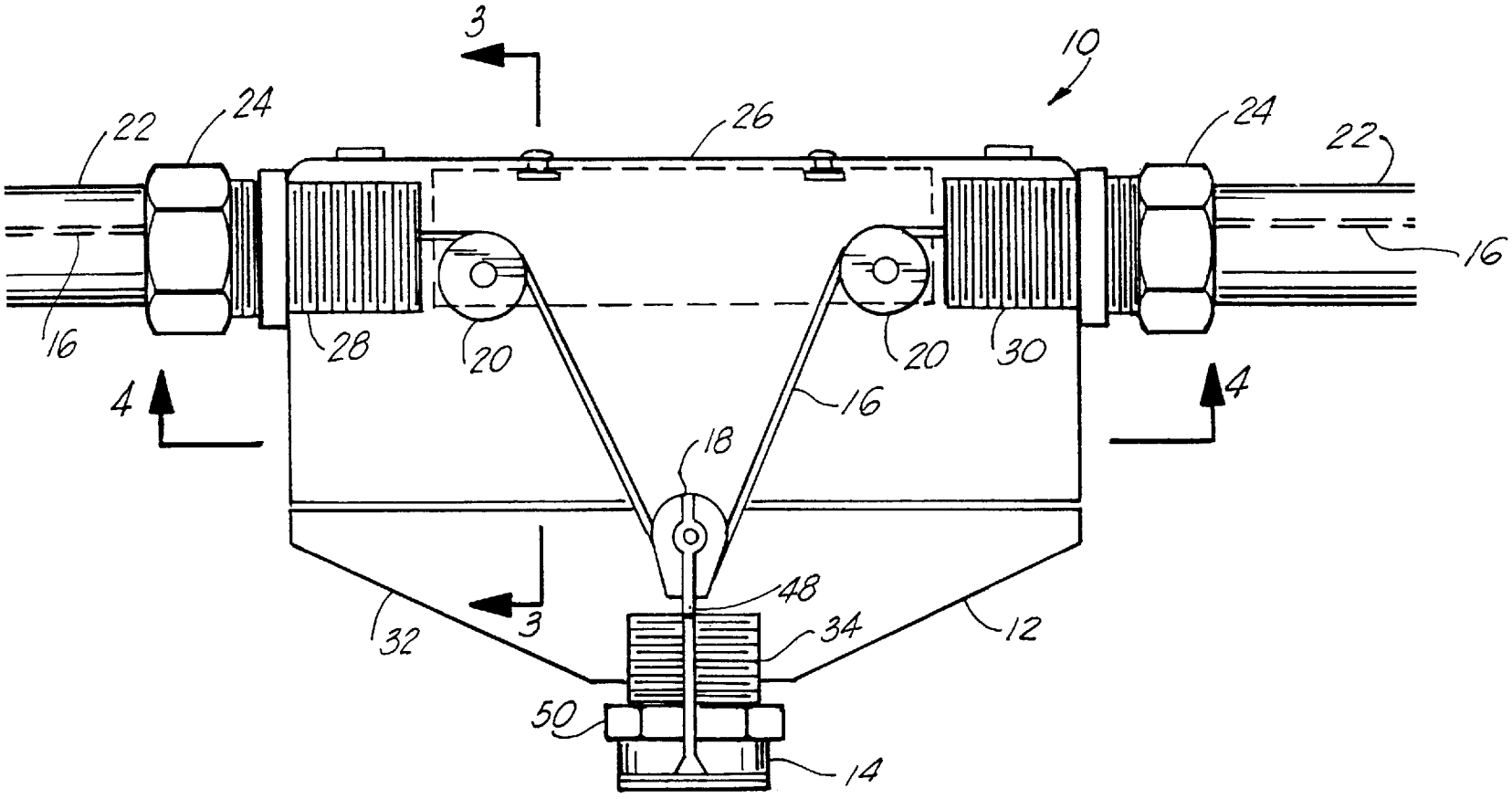
FIG. 1 is a front view of the invention that has been partially cut away so as to show the details within the outer housing.

Referring initially to FIG. 1, there is shown an interior view of totally enclosed fusible disc heat detector 10. As can be seen in this FIG. 1, heat detector 10 consists primarily of outer housing 12, fusible disc 14, fusible disc base 50, cable 16, pulley 18, and cable guides 20. Also disclosed in this FIG. 1 is standard conduit 22 sealably secured to the upper region of housing 12 by threaded fittings 24. Generally, such conduit 22 is ½ inch EMT conduit, but it may also be any other grade, type, or size of conduit (i.e., stainless, aluminum, steel, plastic, etc.) that is desired or which is permitted under local fire codes.

While not shown herein, heat detector 10 is coupled to a typical fire detection system installed in the hood over a stove top. This detection system generally includes a fire extinguisher (such as that shown in U.S. Pat. No. 5,127,479 discussed above) that is biased in the operating position but which is held inoperable by the tension in cable 16. However, whenever any slack occurs within cable 16, such slack enables the fire extinguisher to operate, thereby causing its contents to travel through piping toward discharge ports where such contents are sprayed onto the stove top (and hopefully the undesired heat source). The operation of such a system is automatic and will occur once the heat from the fire (or other heat source) reaches a preset level as determined by the composition of fusible disc 14.

Thus, as can be seen from FIG. 1, once the temperature of fusible disc 14 reaches a certain known level, disc 14 separates, thereby introducing slack in cable 16 in order to activate the accompanying fire detection system. The preset temperature activation level of fusible disc 14 is usually in the range of about 160°–450° F. (more or less) depending on whether the stove top is electric, gas, or uses some other combustible fuel.

Figure 2:
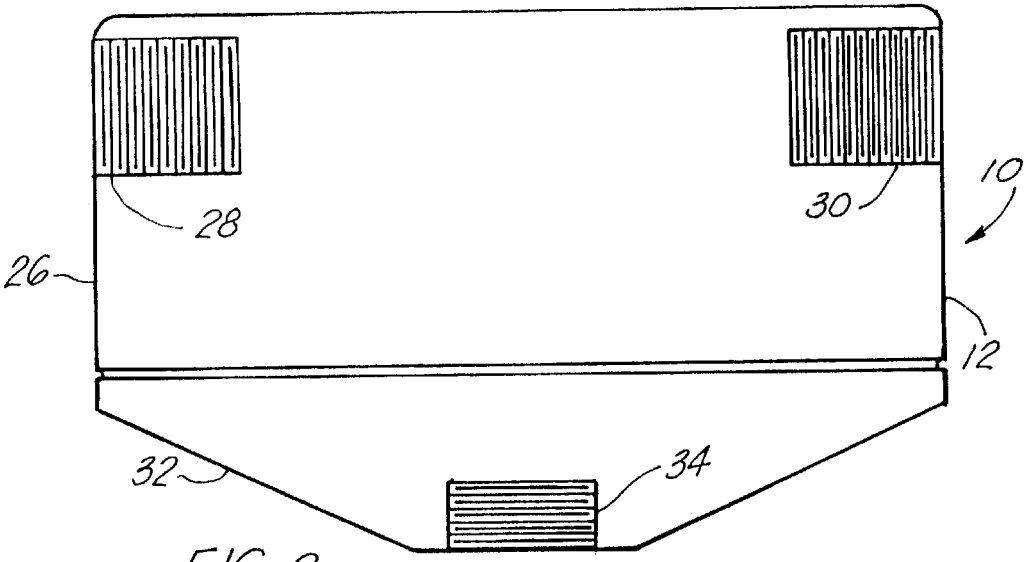
FIG. 2 is a front view of the outside of the housing of this invention which has not been cut away as in FIG. 1.

Referring now more specifically to FIG. 2, upper region 26 of housing 12 is shown as generally being rectangular with the opposite ends of this region 26 containing threaded openings 28 and 30 for the coupling of conduit 22. However, region 26 may also be configured differently and it may also incorporate another manner of attachment for the coupling of conduit 22. In any event, conduit 22, which has cable 16 running through it, is sealably secured to housing 12 in order to prevent any grease or other cooking vapors or contaminants from entering housing 12.

Bottom region 32 of housing 12 is shown as being conically shaped with the apex of this conical section ending in a third opening 34. It is within this third opening 34 that adjustable copper fusible disc base 50 is threaded into housing 12, then fusible disc 14 is sealed in place against fusible disc base 50 by cable tension. Copper fusible disc base 50 is provided to allow fusible disc 14 to seal against its face; unscrewing base 50 slightly will tighten fusible disc 14 against its face. Base 50 is also used to aid in conducting heat and concentrate the heat to melt fusible disc 14 (as base 50 does not melt at the temperature at which disc 14 melts). Generally, opening 34 is threaded, but other methods of attaching or sealing fusible disc 14 to housing 12 can be accommodated. Also, while this FIG. 2 illustrates a removable and replaceable fusible disc 14, this does not necessarily have to be the case as fusible disc 14 can be permanently installed within housing 12 if so desired.

In this preferred embodiment, housing 12 is typically constructed of a metal or other material whose melting point is considerably higher than the preset melting level of fusible disc 14 but which is readily capable of conducting heat. Also, for proper operation, bottom region 32 and upper region 26 should be sealed together, thereby effectively forming a continuous, unitary enclosure.

Figure 3:
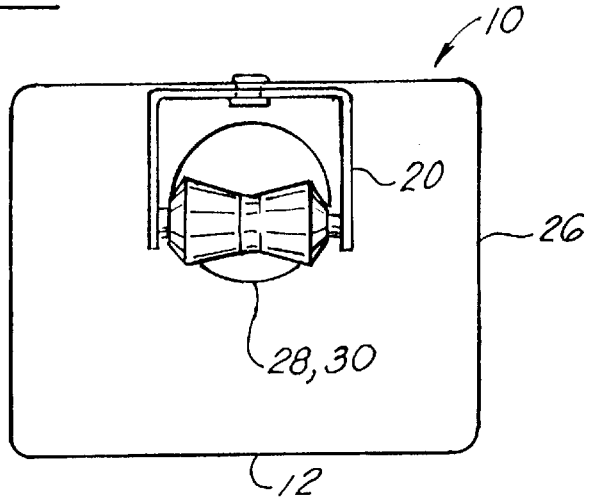
FIG. 3 is an end sectional view of the housing taken along lines 3—3 of FIG. 1.
Figure 4:
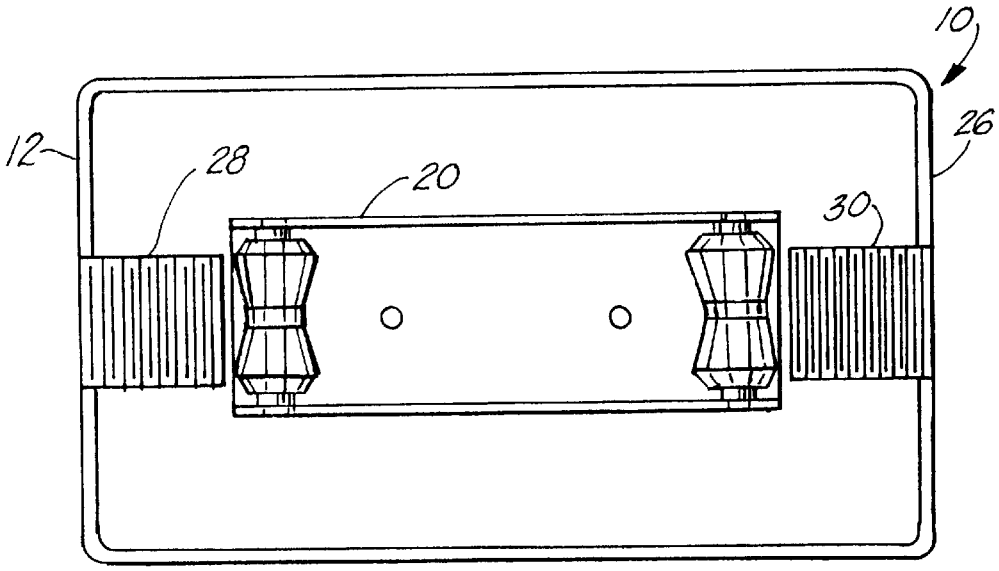
FIG. 4 is a bottom sectional view of the housing taken along lines 4—4 of FIG. 1.

Referring now to FIGS. 3 and 4, the interior of housing 12 is shown in greater detail. As indicated, near each opening 28 and 30 resides a tapered or channeled cable guide 20 around which cable 16 is bent. These cable guides 20 are attached, such as by rivets, to upper region 26 of housing 12 in the normal fashion. The taper of each cable guide 20 maintains the proper alignment of cable 16 with respect to adjacent conduit 22.

Figure 5:
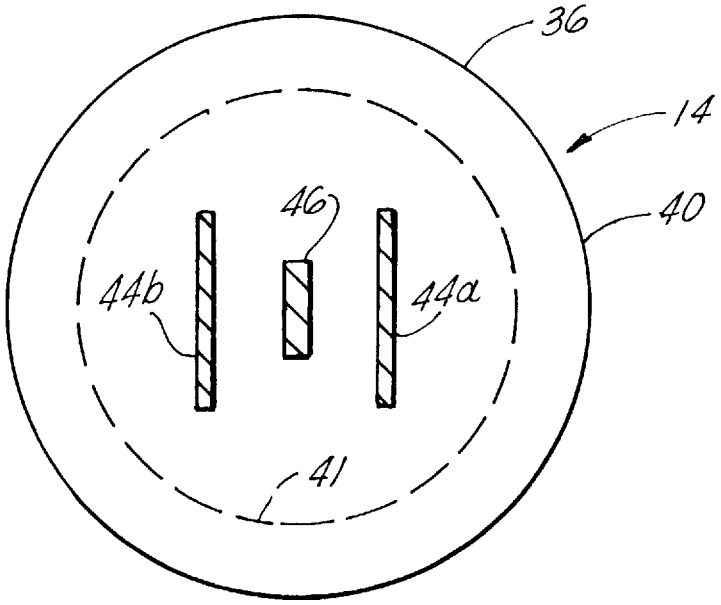
FIG. 5 is a bottom sectional view of the fusible disc taken along lines 5—5 of FIG. 6; and, FIG. 6 is a side view of the fusible disc illustrating the placement of the melting alloy.
Figure 6:
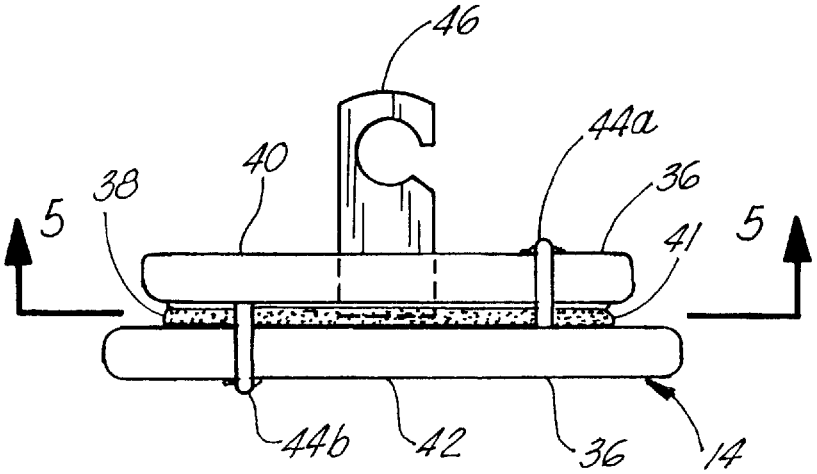

Referring now to FIGS. 5 and 6, there is shown fusible disc 14 in greater detail. Disc 14 is constructed of both a high temperature alloy or material 36 which readily conducts heat (such as copper or the like) and a low temperature melting alloy 38 which is designed to melt at a known temperature. As shown, a layer 41 of melting alloy 38 is sandwiched between upper and lower layers 40 and 42 of heat conductive material 36. Upon the application of sufficient heat, the strength (tensile and otherwise) of melting alloy 38 is significantly reduced such that fusible disc 14 will separate between layers 40 and 42 when under a load.

Small tabs or pins 44*a*, 44*b* extend into layers 40, 42, respectively, from intermediate layer 41, thereby maintaining proper alignment between these layers during manufacture. Tabs 44 also give additional rated strength to fusible disc 14 since the strength of melting alloy 38 is less than that of heat conductive material 36. While tabs 44*a*, 44*b* may be constructed solely of melting alloy 38 (which may not be very strong under tension forces), tabs 44*a*, 44*b* may also be constructed of another material (i.e., heat conductive material 36) which may then be simply encrusted or encased by melting alloy 38.

Extending normally (or upwardly in FIG. 1) from upper layer 40 is hook 46 which is configured to be hooked over depending eyelet 48 of pulley 18 (this eyelet 48 generally being rotatable with respect to pulley 18). Once the two are hooked together, fusible disc 14 comes under tensile forces since it now restrains tensioned cable 16 in an offset position. Of course, other constructions of fusible disc 14 are also possible, this version being selected solely for descriptive purposes.

Referring now again to FIG. 1, fusible disc 14 is secured and sealed within bottom opening 34 of housing 12 such as by disc base 50. Fusible disc 14 may also protrude from housing 12 as shown for greater exposure to any heat that may be generated. Regardless of its manner of attachment, with fusible disc 14 in place, and with conduits 22 installed as indicated, housing 12 becomes sealed, thereby preventing any foreign matter from entering housing 12. Heat, on the other hand, is easily conducted by housing 12, and especially by disc base 50 and by lower layer 42 of fusible disc 14 since at least one side of lower layer 42 remains exposed.

Thus, during operation, once a fire erupts on the stove top, the heat therefrom will be transferred to housing 12 in general and to lower layer 42 in particular. In turn, lower layer 42 transfers this heat to intermediate layer 41. Upon reaching a certain temperature level, either tabs 44*a*, or 44*b* intermediate layer 41 will melt or otherwise undergo a reduction in tensile strength, thereby allowing upper layer 40 to become separated from lower layer 42. Once such separation occurs, cable. 16, which is under tension, will become slack, thereby permitting the fire extinguishing system attached to cable 16 to operate as needed. Thus, disc 14 melts to release cable 16.

It is the introduction of cable slack that must occur before the fire extinguishing system can be operated. Consequently, heat detector 10 discloses a manner and method of causing such slack without the fear that cable 16 will become encrusted or carbonized by the accumulation of grease thereon. Once fusible disc 14 becomes separated upon the application of heat, a new such disc 14 can easily be installed by simply hooking eyelet 48 of pulley 18 with new hook 46.

FIG. 1 also discloses typical pulley 18 which is positioned along cable 16. However, it is clear from FIG. 1 that while pulley 18 is located intermediate openings 28 and 30 of housing 12, pulley 18 is not held or restrained in a colinear arrangement with respect to first and second openings 28 and 30. Instead, pulley 18 is held or retained in an offset position with the degree of offset being determined both by the size of housing 12 and by the amount of slack that is to be introduced into cable 16.

Pulley 18 contains a typical rotatable eyelet 48 that extends downward therefrom and which is used to hook onto fusible disc 14. While not shown, pulley 18 may also contain a tapered or grooved sheave around which cable 16 extends to insure the proper alignment of cable 16. Of course, pulley 18 must be installed along cable 16 before pulley 18 is connected to hook 46. Once fusible disc 14 is installed along cable 16, any slack therein should be removed before the fire extinguisher system is activated. Any fine tuning to the slack in cable 16 can be accomplished by unscrewing or re-positioning fusible disc base 50 with respect to completely sealed fusible disc 14. Also, by screwing fusible disc base 50 into housing 12, a seal between the two is created and maintained which prevents any grease buildup from occurring within housing 12. Thus, upon the occurrence of a fire, the change in the physical properties of melting alloy 38 will cause slack to be introduced within cable 16 thereby causing the fire extinguishing system to become activated.

Housing 12 is secured or connected above the stove top in strategic areas by conventional means, such as via rivets or threaded fasteners or the like. It is placed such that should a fire erupt on the stove top, the heat from the fire will directly impact upon copper fusible disc base 50 and, more particularly, fusible disc 14. There may also be more than one such disc base 50 and, therefore, fusible disc 14, for each stove top (and hence more than one fusible disc 14 along cable 16), depending on the area of the stove top that must be monitored by heat detector 10.

The procedure for installing fusible disc 14 within housing 12 is as follows. First, cable 16 must have slack therein. Second, unhook or remove any old fusible disc 14 that may have already been installed by pulling it down and unhooking it. Third, hook the new fusible disc 14 upon eyelet 48 of pulley 18. Finally, reset cable 16 making sure that all fusible discs 14 are properly seated and are properly sealed within disc bases 50. The final position of fusible disc 14 with respect to its disc base 50 may be adjusted as needed to remove any small amount of slack that may remain in cable 16.

One advantage of heat detector 10 is that it now provides a detection system as described in NFPA 17A section 2-12 which is totally enclosed thereby eliminating problems that previously plagued currently existing designs employing open brackets and fuse links. Some of these problems include difficulty in cleaning grease or other material accumulated on the fuse links and brackets, accidental discharge of the suppression system by tampering or hood cleaning, and carbonizing of grease that insulates the fuse link and/or restrains the cable from proper free movement. These problems potentially prevent the fusible link or the cable from operating as designed thereby preventing the fire extinguisher system from operation in the case of a fire.

This heat detector 10 is also ideal for low profile downdraft exhaust systems using them directly above the appliance as required by NFPA 17A 2-12.3. This detector 10 also meets health department requirements for accumulation of grease above the appliances and eliminates any accidental discharge.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An apparatus for generating cable slack in a tensioned cable upon a presence of flame or excessive heat comprising:

(a) an enclosure having first, second, and third openings therein with the tensioned cable extending between said first and second openings;

(b) a pulley positioned on the cable intermediate said first and second openings, said pulley having an eyelet extending therefrom; and, (c) a fusible disc secured to said third opening with said fusible disc having a hook extending therefrom and into said enclosure, said hook being attached to said eyelet of said pulley for restraining said pulley, and hence the tensioned cable, in a nonlinear or offset position with respect to said first and second openings;

said fusible disc comprising a melting alloy which, upon reaching a known temperature level, undergoes a change in physical properties so as to allow said fusible disc to separate thereby releasing restraint on said pulley and hence introducing the slack into the tensioned cable.

2. The apparatus as set forth in claim 1 further comprising coupling means forming a part of said first and second openings for coupling said first and second openings to tubing or conduit through which the tensioned cable extends.

3. The apparatus as set forth in claim 2, wherein said enclosure is fully sealed.

4. The apparatus as set forth in claim 3, wherein said first and second openings are both positioned in a first region of said enclosure and wherein said third opening is located in an offset or distant region of said enclosure.

5. The apparatus as set forth in claim 4, wherein said fusible disc further comprises a layer of said melting alloy intermediate first and second layers of a heat conductive material.

6. The apparatus as set forth in claim 5, wherein said fusible disc further comprises at least one tab extending between said melting alloy and at least one said layer of said heat conductive material.

7. The apparatus as set forth in claim 6, wherein said tab is constructed of or, at the least, encased by said melting alloy.

8. The apparatus as set forth in claim 7, wherein said hook is secured to said first layer of said heat conductive material.

9. The apparatus as set forth in claim 8, wherein said fusible disc is secured to said third opening and wherein at least one side of said second layer of said heat conductive material is exposed on an exterior of said enclosure.

10. The apparatus as set forth in claim 9, further comprising a series of roller guides attached to said enclosure for maintaining alignment of the tensioned cable within the enclosure.

11. A method of generating cable slack in a tensioned cable upon a presence of flame or excessive heat comprising the steps of:

(a) constructing an enclosure having first, second, and third openings therein with the tensioned cable extending between said first and second openings;

(b) positioning a pulley on the cable intermediate said first and second openings, said pulley having an eyelet extending therefrom;

(c) securing a fusible disc to said third opening with said fusible disc having a hook extending therefrom and into said enclosure, said hook being attached to said eyelet of said pulley for restraining said pulley, and hence the tensioned cable, in a non linear or offset position with respect to said first and second openings; and (d) constructing and arranging said fusible disc with a melting alloy which, upon reaching a known temperature level, undergoes a change in physical properties so as to allow said fusible disc to separate thereby releasing restraint on said pulley and hence introducing the slack into the tensioned cable.

12. The method as set forth in claim 11 further comprising the step of coupling said first and second openings to tubing or conduit through which the tensioned cable extends.

13. The method as set forth in claim 12 further comprising the step of fully sealing said enclosure.

14. The method as set forth in claim 13 further comprising the step of positioning said first and second openings in a first region of said enclosure and positioning said third opening in an offset or distant region of said enclosure.

15. The method as set forth in claim 14 further comprising the step of constructing said fusible disc with a layer of said melting alloy intermediate first and second layers of a heat conductive material.

16. The method as set forth in claim 15 further comprising the step of constructing said fusible disc with at least one tab extending between said melting alloy and at least one said layer of said heat conductive material.

17. The method as set forth in claim 16 further comprising the step of constructing said tab of, or, at the least, encasing said tab within, said melting alloy.

18. The method as set forth in claim 17 further comprising the step of securing said hook to said first layer of said heat conductive material.

19. The method as set forth in claim 18 further comprising the step of threadably securing said fusible disc to said third opening and also exposing at least one side of said second layer of said heat conductive material on an exterior of said enclosure.

20. The method as set forth in claim 19 further comprising the step of maintaining alignment of the tensioned cable within the enclosure via a series of roller guides attached to said enclosure.

* * * * *